US010047449B2

(12) United States Patent
Lorenz et al.

(10) Patent No.: US 10,047,449 B2
(45) Date of Patent: Aug. 14, 2018

(54) DEVICE AND METHOD FOR ELECTROLYTICALLY COATING AN OBJECT

(71) Applicant: Maschinenfabrik NIEHOFF GmbH & Co. KG, Schwabach (DE)

(72) Inventors: Dagmar Lorenz, Schwabach (DE); Klaus Menningen, Sessenhausen (DE); Markus Raab, Wolframs-Eschenbach (DE)

(73) Assignee: Maschinenfabrik NIEHOFF GmbH & Co. KG, Schwabach (DE)

( * ) Notice: Subject to any disclaimer, the term of this patent is extended or adjusted under 35 U.S.C. 154(b) by 231 days.

(21) Appl. No.: 14/742,542

(22) Filed: Jun. 17, 2015

(65) Prior Publication Data

US 2015/0284867 A1 Oct. 8, 2015

Related U.S. Application Data

(63) Continuation of application No. PCT/EP2013/003710, filed on Dec. 9, 2013.

(30) Foreign Application Priority Data

Dec. 18, 2012 (DE) ..... 10 2012 024 758

(51) Int. Cl.
*C25D 21/12* (2006.01)
*C25D 5/18* (2006.01)
(Continued)

(52) U.S. Cl.
CPC ..... *C25D 5/18* (2013.01); *C25D 3/30* (2013.01); *C25D 7/0607* (2013.01);
(Continued)

(58) Field of Classification Search
CPC ..... C25D 21/14; C25D 7/06–7/0692
See application file for complete search history.

(56) References Cited

U.S. PATENT DOCUMENTS 1,465,034 A 8/1923 Antisell
4,169,780 A 10/1979 Stiker et al.
(Continued)

FOREIGN PATENT DOCUMENTS

AU 644022 B2 12/1993
CN 87211969 U 7/1988
(Continued)

OTHER PUBLICATIONS

International Search Report and Written Opinion dated Apr. 4, 2014 for corresponding Application PCT/EP2013/003710.
Japanese Office Action dated Dec. 19, 2016 for corresponding Application No. 2015-546894 (11 pages).
Office Action issued in related Russian application 2015117784/02(027616) on Apr. 14, 2017.
Search Report dated Apr. 19, 2018 in related European Application No. 13811125.7.

*Primary Examiner* — Nicholas A Smith
(74) *Attorney, Agent, or Firm* — Knobbe Martens Olson & Bear LLP

(57) ABSTRACT

A device for electrolytically coating an object is disclosed. In one aspect, the device includes an electrolyte container containing an electrolyte and a first DC power source. The device also includes at least one soluble anode which is at least partly immersed into the electrolyte and electrically conductive connected to a positive pole of the first DC power source. The device also includes at least one cathode terminal which is electrically conductive connected to a negative pole of the first DC power source and to which the object is electrically conductive connected, the object being immersed into the electrolyte. The device further includes a
(Continued)

second DC power source configured to operate independently of the first DC power source and at least one insoluble anode, which is at least partly immersed into the electrolyte and electrically conductive connected to a positive pole of the second DC power source.

11 Claims, 1 Drawing Sheet

(51) Int. Cl.

| | |
|---|---|
| ***C25D 7/06*** | (2006.01) |
| ***C25D 3/30*** | (2006.01) |
| ***C25D 17/10*** | (2006.01) |
| ***C25D 21/14*** | (2006.01) |
| ***C25D 17/00*** | (2006.01) |

(52) U.S. Cl.
CPC ..... *C25D 7/0614* (2013.01); *C25D 17/007* (2013.01); *C25D 17/10* (2013.01); *C25D 21/12* (2013.01); *C25D 21/14* (2013.01)

(56) References Cited

U.S. PATENT DOCUMENTS

| | | | |
|---|---|---|---|
| 4,419,192 | A | 12/1983 | Dahms |
| 4,514,266 | A | 4/1985 | Cole et al. |
| 5,100,517 | A | 3/1992 | Starinshak et al. |
| 5,441,620 | A | 8/1995 | Nishimura et al. |

FOREIGN PATENT DOCUMENTS

| | | | |
|---|---|---|---|
| CN | 1061055 | A | 5/1992 |
| CN | 1477238 | A | 2/2004 |
| DE | 4235227 | A1 | 4/1994 |
| DE | 195 39 865 | A1 | 4/1997 |
| DE | 19539865 | A1 | 4/1997 |
| JP | S58-100695 | A | 6/1983 |
| JP | S63-086886 | A | 4/1988 |
| JP | S63-317698 | A | 12/1988 |
| JP | H04-191394 | A | 7/1992 |
| JP | H04-284691 | | 10/1992 |
| RU | 2431000 | C2 | 10/2011 |

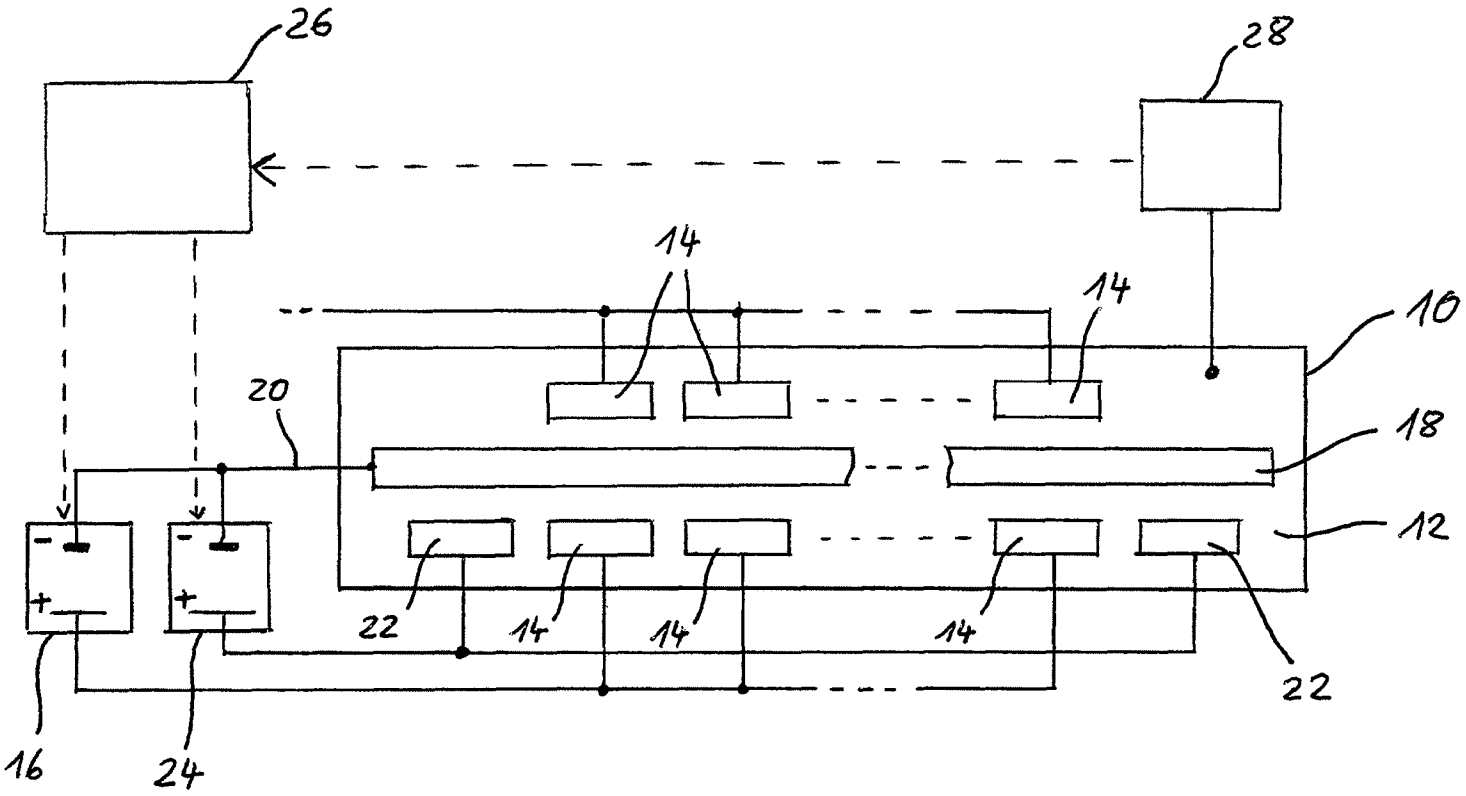
28
26
10
18
12
22
14
14
14
14
14
22
20
24
16

DEVICE AND METHOD FOR ELECTROLYTICALLY COATING AN OBJECT

CROSS-REFERENCE TO RELATED APPLICATIONS

This application is a continuation application, and claims the benefit under 35 U.S.C. §§ 120 and 365 of PCT Application No. PCT/EP2013/003710, filed on Dec. 9, 2013, which is hereby incorporated by reference. PCT/EP2013/003710 also claimed priority from German Patent Application No. 10 2012 024 758.3 filed on Dec. 18, 2012, which is hereby incorporated by reference.

BACKGROUND

Field

The described technology generally relates to a device and a method for an electrolytic coating of an object, for example, a wire.

Description of the Related Technology

It is well known to coat metallic objects, such as wires electrolytically in an electroplating plant, for example, by tin coating. For this, the wire and the coating material are immersed into an electrolyte bath, and therefore, they are electrically conductive connected to each other. If the wire and the coating material are connected to different poles of a DC power source, then—in the case of a sufficiently high voltage—an electric current flows, which causes the ions in the electrolyte to migrate to the wire or to the coating material, respectively (electrolysis).

The wire is connected to the negative pole of the DC power source and forms the cathode. The positively charged metal ions migrate in the electrolyte to the cathode and then they receive the electrons (electrochemical reduction), whereby metal atoms are formed, which attach to the wire to be coated. Concerning the anodes, a distinction is made between the so-called soluble anodes and the so-called insoluble anodes. For the soluble anodes, the anode metal dissolves by donating electrons to the circuit (electrochemical oxidation) and it goes as a metal ion into the electrolyte (usually a salt solution). However, the insoluble anodes do not dissolve, but serve only for contacting the electrolyte to form the metal ions in the electrolyte (usually a metal salt solution). In the case of the soluble anodes, these anodes dissolve with time; in the case of the insoluble anodes, the electrolyte is depleted of the metal with time.

For the acid electrolytes, such as tin electrolytes on the basis of methane sulfonic acid, for the use of soluble anodes, there is always a difference between anodic and cathodic current efficiency. The anodic current efficiency is usually close to 100%, while the cathodic current efficiency, for example for the methane sulfonic acid tin electrolytes, is usually somewhere between 95% and 97%. The cathodic current efficiency depends in particular on the coating material, the electrolyte and the operating parameters (bath temperature, agitation, current density, etc.).

For conventional electroplating systems, the above described difference between the anodic and cathodic current efficiency results in an increase of the metal concentration in the electrolyte which has to be corrected upon reaching a predetermined upper threshold value. To keep the metal concentration in the electrolyte within a predetermined range, the electrolyte can be regenerated, for example, regularly or continuously.

On the other hand, for using the insoluble anodes, it is required to correct the metal concentration upon reaching a predetermined lower threshold value. To keep the metal concentration in the electrolyte within a predetermined range, it is also possible in this case to regenerate the electrolyte periodically or continuously. For example, DE 195 39 865 A1 discloses a throughput electroplating plant with insoluble anodes in the electrolytic cell, wherein the electrolyte is enriched in a regenerating room continuously with metal ions.

Furthermore, DE 195 39 865 A1 describes the use of the insoluble anodes in the electrolytic cell, which are shielded from the electrolyte by diaphragms, and the use of the soluble anodes in an external regenerating room for supplementing the metal content in the electrolyte.

SUMMARY OF CERTAIN INVENTIVE ASPECTS

One inventive aspect relates to an improved device and an improved method for an electrolytic coating of an object.

Another aspect is a device for an electrolytic coating of an object that comprises: an electrolyte container with an electrolyte; a first DC power source; at least one soluble anode, which is at least partially immersed in the electrolyte in the electrolyte container and which is electrically conductive connected to a positive pole of the first DC power source; and at least one cathode terminal which is electrically conductive connected to a negative pole of the first DC power source and which can be electrically conductive connected with the object to be coated which a submerged into the electrolyte in the electrolyte container. This device is characterized by a second DC power source, which can be operated independently of the first DC power source; and at least one insoluble anode that is at least partially immersed into the electrolyte in the electrolyte container and which is electrically conductive connected to a positive pole of the second DC power source.

For the device according to some embodiments, the metal concentration in the electrolytes may be controlled by the at least one insoluble anode. Since the second DC power source can be operated independently of the first DC power source, it is possible with a corresponding operation of the two DC power sources to balance by the at least one insoluble anode the difference between the anodic current efficiency and the cathodic current efficiency of the at least one soluble anode, and so the metal concentration is kept constant in a predetermined range.

The second DC power source can be operated continuously or it is turned on only as needed.

In this context, the term "electrolyte" shall mean a liquid that can dissociate into ions, and which is therefore suitable for electrolysis, and which is in particular suitable for an electroplating system. The chemical composition of the electrolyte depends in particular on the material of the object to be coated, the material of the anodes, in particular the soluble anodes, and the desired coating material. For tin coating of a (copper) wire, a methane sulfonic acid electrolyte can be used.

In this context, the term "DC source" shall mean any type of a device which is adapted to provide a DC voltage at its output, and thus to provide a connected consumers with direct current. For the DC power sources can be used batteries, accumulators, fuel cells, or rectifiers. The rectifiers can be arranged downstream to an AC power source as an alternating current generator, or a supply network. The DC power source can include a DC voltage providing means or a plurality of (substantially similar) parallel connected DC voltage providing devices.

In this context, the term "soluble anode" can mean an anode which dissolves by the electrochemical oxidation in the electrolyte with time by forming the coating material metal by releasing electrons to the circuit as it goes as a metal ion into the electrolyte. For the tin coating of a (copper) wire, a tin anode can be used.

In this context, the term "insoluble anode" can mean an anode that with time substantially does not dissolve into the electrolyte, but only serves for the electrical contacting of the electrolyte. The insoluble anodes can also be referred to as dimensionally stable or inert anodes. The insoluble anodes can include substantially stainless steel, titanium or platinum and/or are provided with a protective layer of titanium, platinum, iridium, ruthenium or the like.

The device has at least one soluble anode and at least one insoluble anode, which immerge at least partially into the electrolyte. In some embodiments, both types of anode are immersed into the same electrolyte, into which the object to be coated is also immersed. For this, one, two, three, four or more soluble anodes are used. In the case of a throughput electroplating system, depending on the size of the throughput electrolyte container, a greater number of soluble anodes are used. In addition, one, two, three, four or more insoluble anodes are used. The total effective surface area of all the soluble anodes can be greater than the total effective surface area of all the insoluble anodes. The soluble and the insoluble anodes can be dimensioned substantially the same. In this case, the number of the insoluble anodes can be smaller than the number of the soluble anodes.

The object to be coated, which is immersed into the electrolyte in the electrolyte container, can be connected to a cathode terminal of the device, which is electrically conductive connected to a negative pole of the first DC power source. In this context, the cathode terminal is a device, which is suitable to produce an electrically conductive connection with the object to be coated. This compound can be detachable, so that it can simply replace the object to be coated. For a continuous electroplating plant, this connection can be configured such that it can move. The cathode connection can also be electrically conductive connected to the negative pole of the second DC power source, so that the two DC power sources are at the same potential.

In some embodiments, the strength of the current of the second DC power source can be set independently of the strength of the current of the first DC power source. By regulating the strength of the current in the circuit of at least one insoluble anode via said at least one insoluble anode, the difference between the anodic current efficiency and the cathodic current efficiency can be balanced for the at least one soluble anode, so that the metal concentration can be kept constant in a predetermined range.

In some embodiments, a control device is provided for driving the first DC power source and/or for driving the second DC power source as a function of at least one electrolytic parameter of the electrolyte in the electrolyte container. The two DC power sources can be controlled to, for example, control the strengths of the current in both circuits. In this context, the term "electrolytic parameter" can mean an operating parameter of the device, which influences the electrolysis in the electrolyte, and thus the electrolytic coating of the object to be coated. In this context, the electrolytic parameters comprises, for example, but not exclusively the metal (ion) content, the acidity, the pH value and the conductivity of the electrolyte and the strength of the current and the throughput speed.

In some embodiments, a measuring device is provided for detecting the at least one electrolytic parameter of the electrolyte in the electrolyte container. Concerning this measuring device, it can be a measuring device arranged separately from the electrolyte container and to which regularly electrolyte samples taken from the electrolyte container are supplied for analysis; or it can be a measurement apparatus being in contact with the electrolyte in the electrolyte container in order to carry out a substantially continuous analysis.

The device according to some embodiments is constructed as a throughput device for the continuous electrolytic coating of the object. The throughput device can be particularly used for the coating of a wire or strip material.

The method for an electrolytic coating of an object comprises the steps of: immersing the object to be coated in an electrolyte container having an electrolyte, in which immerse, at least in part, at least one soluble anode, which is electrically conductive connected to a positive pole of a first DC power source, and at least one insoluble anode, which is electrically connected to a positive terminal of a second DC power source; connecting the object to be coated electrically conductive with a negative pole of the first DC power source and a negative pole of the second DC power source; and operating the second DC power source independently of the first DC power source.

With this method, the same advantages can be achieved as for the above described device. For the advantages, the definitions and the example embodiments it is therefore referred at this point only to the above mentioned statements in connection with the device according to some embodiments.

In some embodiments, the strength of the current of the first DC power source and the strength of the current of the second DC power source can be set differently to each other.

In some embodiments, a total strength of the current of the first DC power source and of the second DC power source is kept substantially constant.

In some embodiments, the first DC power source, the second DC power source, or both DC power sources are controlled as a function of at least one electrolytic parameter of the electrolyte in the electrolyte container.

In some embodiments, the at least one electrolytic parameter of the electrolyte in the electrolyte container is detected periodically or continuously.

In some embodiments, the object is coated continuously electrolytically in a continuous process.

The described technology can be used for the electrolytic coating of a wire, for example, in a continuous process.

As a precaution, it should be noted at this point that for the device and for the method, each are not limited to any special object to be coated, to any special electrolyte, to any special coating material, to any specific soluble anodes or to any special insoluble anodes.

BRIEF DESCRIPTION OF THE DRAWINGS

FIG. 1 shows a continuous electroplating system according to some embodiments.

DETAILED DESCRIPTION OF CERTAIN INVENTIVE EMBODIMENTS

Embodiments will be described with reference to the accompanying drawing. Here, the only one FIG. 1 shows for the most part schematically the structure of a continuous electroplating system according to some embodiments.

The inventive technology will be described in detail using the example of a continuous electroplating plant; but it is equally applicable to batch electroplating plants.

The electroplating plant has a large oblong electrolyte container 10 for receiving a suitable electrolyte 12. For example, for a tin coating, a methane sulfonic acid electrolyte 12 is used.

In the electrolyte container 10, a plurality of soluble tin anodes 14 is arranged. As indicated in FIG. 1, these anodes can be arranged in two rows in pairs opposite to one another. The tin anodes 14 immerse each into the electrolyte 12 in an electrolyte container 10.

The tin anodes 14 are all electrically conductive connected to a positive terminal of a first DC power source 16. The first DC power source 16 is, for example, a rectifier which is connected to a supply network or to an AC generator. The first DC power source 16 is designed, for example, for a total strength of the current of about 6,500 A.

The wire 18 to be coated is immersed in a continuous process in the electrolyte 12 in the electrolyte container 10. For this purpose, the corresponding conveying devices are provided, which are not shown in FIG. 1. The conveying speed of the wire 18 through the electrolyte 12 is adjusted to the desired coating thickness.

The wire 18 to be coated is contacted electrically conductive by a cathode terminal 20, which is electrically conductive connected to the negative pole of the first DC power source 16. In this way, a closed circuit is established from the positive pole of the first DC power source 16 via the soluble tin anodes 14, the electrolyte 12, the wire 18 and the cathode terminal 20 to the negative pole of the first DC power source 16.

In addition to the soluble tin anodes 14, additional insoluble anodes 22 are provided such that they are also immersed in the electrolyte 12 in the electrolytic container 10. As indicated in FIG. 1, the soluble anodes 14 and the insoluble anode 22 are substantially equal in the size and in the shape, but the number of the insoluble anode 22 is significantly smaller than the number of soluble anodes 14. The effective total surface area of all soluble anodes 14 immersing in the electrolyte 12 is significantly greater than the effective total surface area of all the insoluble anodes 22.

The insoluble anodes 22 are all electrically conductive connected to a positive terminal of a second DC power source 24. The second DC power source 24 is analogous to the first DC power source 16, for example, a rectifier, which is connected to a supply network or to an AC generator. The second DC power source 24 is designed, for example, for a total strength of the current in the range of about 50 to 150 A.

The cathode terminal 20 contacting the wire 18 to be coated is also connected to the negative pole of this second DC power source 24. In this manner, the negative poles of the first DC power source 16 and the second DC power source 24 are on the same potential.

According to some embodiments, the first DC power source 16 and the second DC power source can be operated independently. In particular, the strengths of the current of the two DC power sources 16, 24 can be adjusted independently.

For this purpose, a control device 26 is provided, which controls the first DC power source 16 and the second DC power source 24.

This control device 26 is connected to a measuring device 28, which is designed to detect at least one electrolytic parameter of the electrolyte 12 in the electrolyte container 10. This can be done, for example continuously, by a direct measurement of the parameter in the electrolyte container 10 or by a regular sampling of the electrolyte container 10 and a subsequent analysis separately from the electrolyte container.

Concerning the electrolytic parameter, it is an operating parameter which influences the electrolysis in the electrolyte, and thus the electrolytic coating of the object to be coated. As electrolytic parameters are detected, for example, the metal (ion) content, the acid content, the pH and/or the conductivity of the electrolyte 12 by the measuring device 28. Further operating parameters, which can be detected in this context, by the measuring device 28, are the strength of the current and the throughput speed, which also affect the electrolytic coating of the object.

The strength of the current calculated for the coating process corresponds, for example, 100%, i.e., the metal ions required for the desired thickness are passing from the soluble anodes 14 in the electrolyte solution 12. The cathodic current efficiency is, however, for example, only about 97%. With time, therefore, it would increase the metal (ion) concentration in the electrolyte 12.

To prevent this, for the device according to some embodiments, the 26 control device can switch on the second DC power source 16 and whereby the missing 3% of the cathodic current efficiency can be compensated. Since the insoluble anodes 22 release no metal ions into the electrolyte, but only serve as the power supply, in this way, the metal concentration in the electrolyte can essentially be kept constant or kept constant within a predetermined range.

This is further illustrated in the example of a methane sulfonic acid electrolyte tin coating of a wire. For a wire diameter of about 1.6 mm and a desired tin coating thickness of about 5 μm, the wire 18 is conveyed, for example with a speed of about 10 m/s through the electrolyte 12.

For a tin coating current of about 3,000 A (corresponding to an anodic current efficiency of the soluble tin anodes 14 of about 100%) and a cathodic current efficiency of about 97%, the control device 26 controls the second DC power source 24 such that the difference of the current efficiency of about 3% is balanced, meaning that a current of about 90 A (=3%×3,000 A) is provided.

In addition to keeping constant the metal (ion) concentration in the electrolyte 12, it is also possible to correct an excessive metal content in the electrolyte 12. At a too high metal (ion) concentration in the electrolyte 12, which is detected by the measuring device 28, the strength of the current of the first DC power source 16 can be reduced in the inventive device by the control device 26 and the strength of the current of the second DC power source 24 can be increased accordingly. If the increase in the strength of the current of the second DC power source 24 is sized larger than the reduction of the strength of the current of the first DC power source 16, the metal content in the electrolyte 12 can be reduced with the time.

While the inventive technology has been described with reference to the figures, it will be understood by those of ordinary skill in the art that various changes in form and details may be made therein without departing from the spirit and scope as defined by the following claims.

What is claimed is:

1. A throughput device for continuously electrolytically coating an object, comprising:

an electrolyte container containing an electrolyte;

a first DC power source;

a plurality of soluble anodes at least partly immersed into the electrolyte in the electrolyte container and electrically conductively connected to a positive pole of the first DC power source;

at least one cathode terminal which is electrically conductively connected to a negative pole of the first DC power source, wherein the object to be coated is electrically conductively connected to the at least one cathode terminal, wherein the object is immersed into the electrolyte in the electrolyte container, and wherein the object is configured to move through the electrolyte;

a second DC power source configured to operate independently of the first DC power source; and at least one insoluble anode at least partly immersed into the electrolyte in the electrolyte container and electrically conductively connected to a positive pole of the second DC power source, wherein the soluble anodes and the at least one insoluble anode have substantially the same dimension, and wherein the number of the at least one insoluble anode is less than the number of the soluble anodes.

2. The device according to claim 1, wherein the strength of the current of the second DC power source is configured to be adjusted independently of the strength of the current of the first DC power source.

3. The device according to claim 1, further comprising a control device configured to drive the first DC power source and/or the second DC power source as a function of at least one electrolytic parameter of the electrolyte in the electrolyte container.

4. The device according to claim 3, further comprising a measuring device configured to detect the at least one electrolytic parameter of the electrolyte in the electrolyte container.

5. The device according to claim 1, wherein the soluble anodes and the at least one insoluble anode have substantially the same size and shape.

6. A method of electrolytically coating an object in a continuous process, comprising:

immersing an object to be coated into an electrolyte container containing an electrolyte into which a plurality of soluble anodes electrically conductively connected to a positive pole of a first DC power source are at least partially immersed, wherein at least one insoluble anode is electrically conductively connected to a positive pole of a second DC power source, wherein the at least one insoluble anode is at least partially immersed into the electrolyte in the electrolyte container, wherein the soluble anodes and the at least one insoluble anode have substantially the same dimension, and wherein the number of the at least one insoluble anode is less than the number of the soluble anodes;

connecting the object electrically conductively to a negative pole of the first DC power source and a negative pole of the second DC power source, wherein the object is configured to move through the electrolyte; and operating the second DC power source independently of the first DC power source.

7. The method according to claim 6, wherein the strength of the current of the first DC power source and the strength of the current of the second DC power source are set differently to each other.

8. The method according to claim 6, wherein the total strength of the current of the first DC power source and the second DC power source is kept substantially constant.

9. The method according to claim 6, wherein the first DC power source and/or the second DC power source are configured to be driven in the electrolyte container as a function of at least one electrolytic parameter of the electrolyte.

10. The method according to claim 9, wherein the at least one electrolytic parameter of the electrolyte is configured to be detected in the electrolyte container periodically or continuously.

11. The method according to claim 6, wherein the soluble anodes and the at least one insoluble anode have substantially the same size and shape.

* * * * *